United States Patent [19]

Sundberg

[11] 4,354,809

[45] Oct. 19, 1982

[54] FIXED DISPLACEMENT VANE PUMP WITH UNDERVANE PUMPING

[75] Inventor: Jack G. Sundberg, Meriden, Conn.

[73] Assignee: Chandler Evans Inc., West Hartford, Conn.

[21] Appl. No.: 126,432

[22] Filed: Mar. 3, 1980

[51] Int. Cl.[3] ..... F04C 2/00

[52] U.S. Cl. ..... 418/268

[58] Field of Search ..... 418/268, 267; 417/204

[56] References Cited

U.S. PATENT DOCUMENTS

| | | | |
|---|---|---|---|
| 2,545,238 | 3/1951 | MacMillin et al. | 418/268 |
| 3,102,493 | 9/1963 | Davin | 418/268 X |
| 3,279,387 | 10/1966 | McGill | 418/267 |
| 3,329,067 | 7/1967 | Rosaen | 418/268 |
| 3,711,227 | 1/1973 | Schmitz | 418/268 X |

FOREIGN PATENT DOCUMENTS

| | | | |
|---|---|---|---|
| 337376 | 10/1930 | United Kingdom | 418/267 |

*Primary Examiner*—Richard E. Gluck

*Attorney, Agent, or Firm*—Radford W. Luther; Richard A. Dornon

[57] ABSTRACT

A fluid displacement vane pump with undervane pumping has a rotor assembly incorporating a plurality of T-shaped vanes. The outboard undervane surfaces are subjected to the pressure adjacent one side of the vane and the inboard undervane surface is subjected to the pressure adjacent the other side of the vane so that the vanes are hydraulically balanced in the seal arcs as well as in the inlet and discharged arcs. End caps mounted on the rotor function to isolate the undervane cavities and provide uninterrupted bearing surfaces capable of supporting a lubricating hydrodynamic film.

6 Claims, 10 Drawing Figures

2
2

DISCHARGE
INLET
INLET
DISCHARGE

FIXED DISPLACEMENT VANE PUMP WITH UNDERVANE PUMPING

BACKGROUND OF THE INVENTION

This invention relates to vane pumps and more particularly to vane pumps incorporating undervane pumping.

In general, the typical vane pump does not incorporate an undervane pumping feature. However, those pumps embodying this feature have no provision for balancing the pressure forces in the seal arcs between the inlet and discharge ports. Unless the vanes are sufficiently heavy, such pressure forces can overcome the centrifugal forces in the seal arcs, thereby causing the vanes to depart from engagement with the cam surface.

Many existing vane pumps employ pressure loaded sideplates to compensate for thermal expansion. Usually, this mandates the use of highly wear resistant materials, such as tungsten carbide, for the vanes and sideplates and begets attendant manufacturing difficulties. In addition, the ends of the rotor do not readily lend themselves to the inclusion of a thrust carrying bearing owing to the sliding engagement between the vane ends and the sideplates and the small length lands between the vane slots with sharp corners. It will be appreciated, for the above reasons, that the ends of a conventional rotor are not ideally suited to supporting a hydrodynamic lubricating film and are, therefore, limited in their load carrying capacity.

SUMMARY OF THE INVENTION

The invention provides a vane pump incorporating undervane pumping wherein the vanes are hydraulically balanced in not only the inlet and discharge arcs but also in the seal arcs whereby the resultant pressure forces on a vane cannot displace it from engagement with a seal arc. Also, a pump of the invention may incorporate caps on the ends of the rotor which are capable of supporting a hydrodynamic lubricating film.

In accordance with the invention, different undervane portions of a suitably shaped vane are subjected to the respective pressures on either side thereof such that the vane is balanced in the seal arcs. Of course, this manner of pressure distribution also inherently results in hydraulic vane balance in the discharge and inlet arcs. By virtue of the vane balance in the seal arcs, there is no tendency for the vanes to depart from the cam surface when passing thereover.

In order to provide different pressures to various portions of the undervane surface, it is necessary to define isolated undervane cavities. According to the invention, the undervane cavities are in part formed by end caps mounted in the ends of the rotor. However, in a pump of the invention, the end caps serve a dual purpose in that they also provide an uninterrupted bearing surface capable of supporting a hydrodynamic lubricating film adapted to carry a substantial load.

Accordingly, it is a primary object of the invention to provide a vane pump having undervane displacement in which the vanes are hydraulically balanced in seal arcs.

Another object is to provide a vane pump having a rotor with end caps adapted to furnish a suitable bearing surface.

These and other objects and advantages of the invention will become more readily apparent from the following detailed description when taken in conjunction with the accompanying drawings, in which:

DETAILED DESCRIPTION OF PREFERRED EMBODIMENTS

Figure 1:
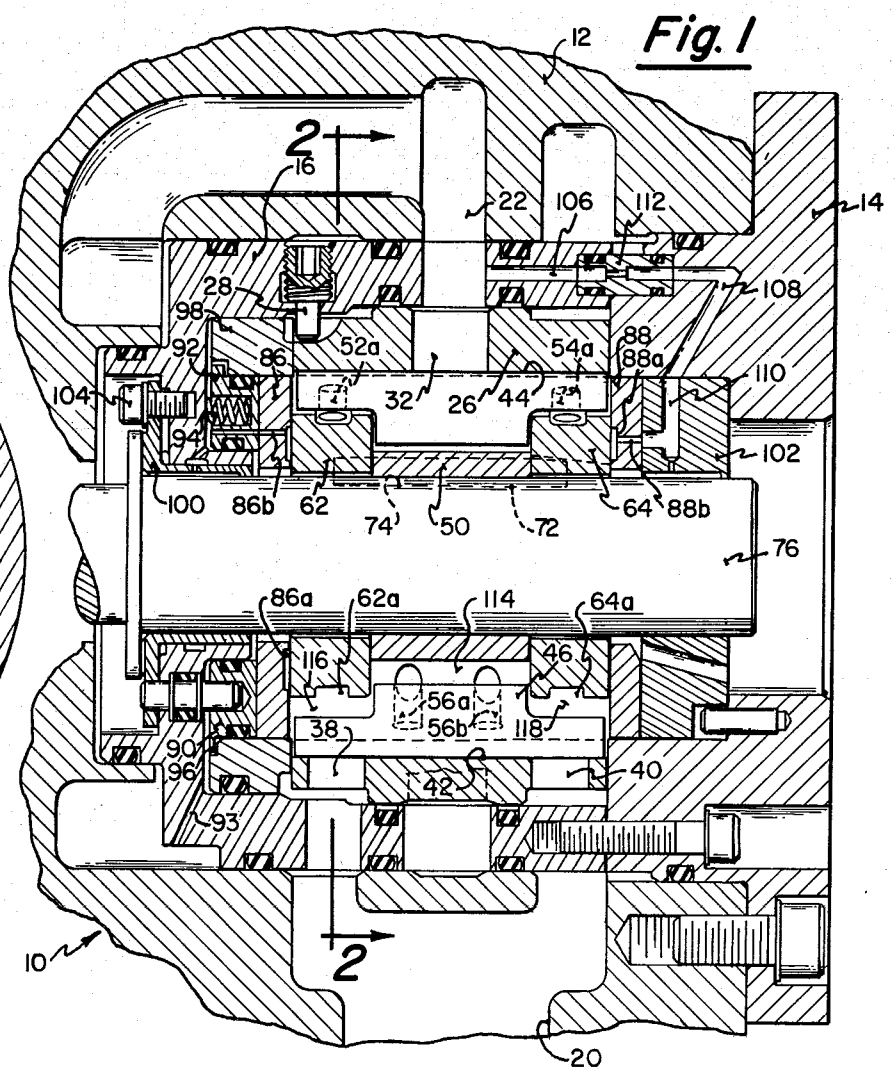
FIG. 1 is a longitudinal sectional view of a vane pump of the invention.
Figure 2:
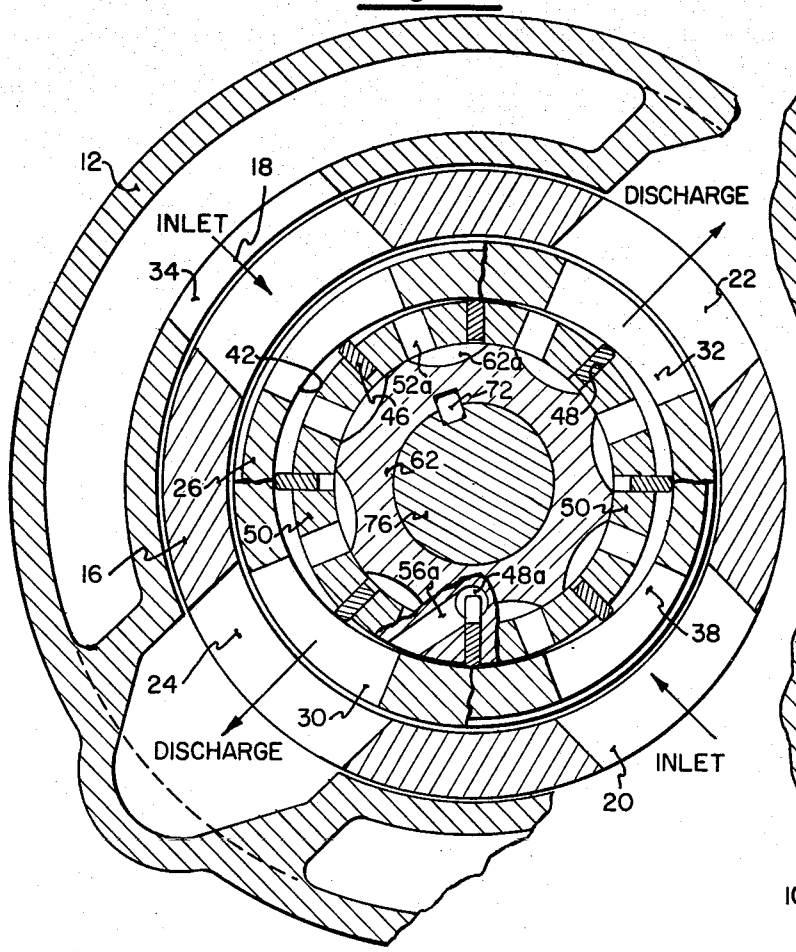
FIG. 2 is a transverse sectional view of the pump of FIG. 1, generally taken along the line 2—2 thereof.
Figure 3:
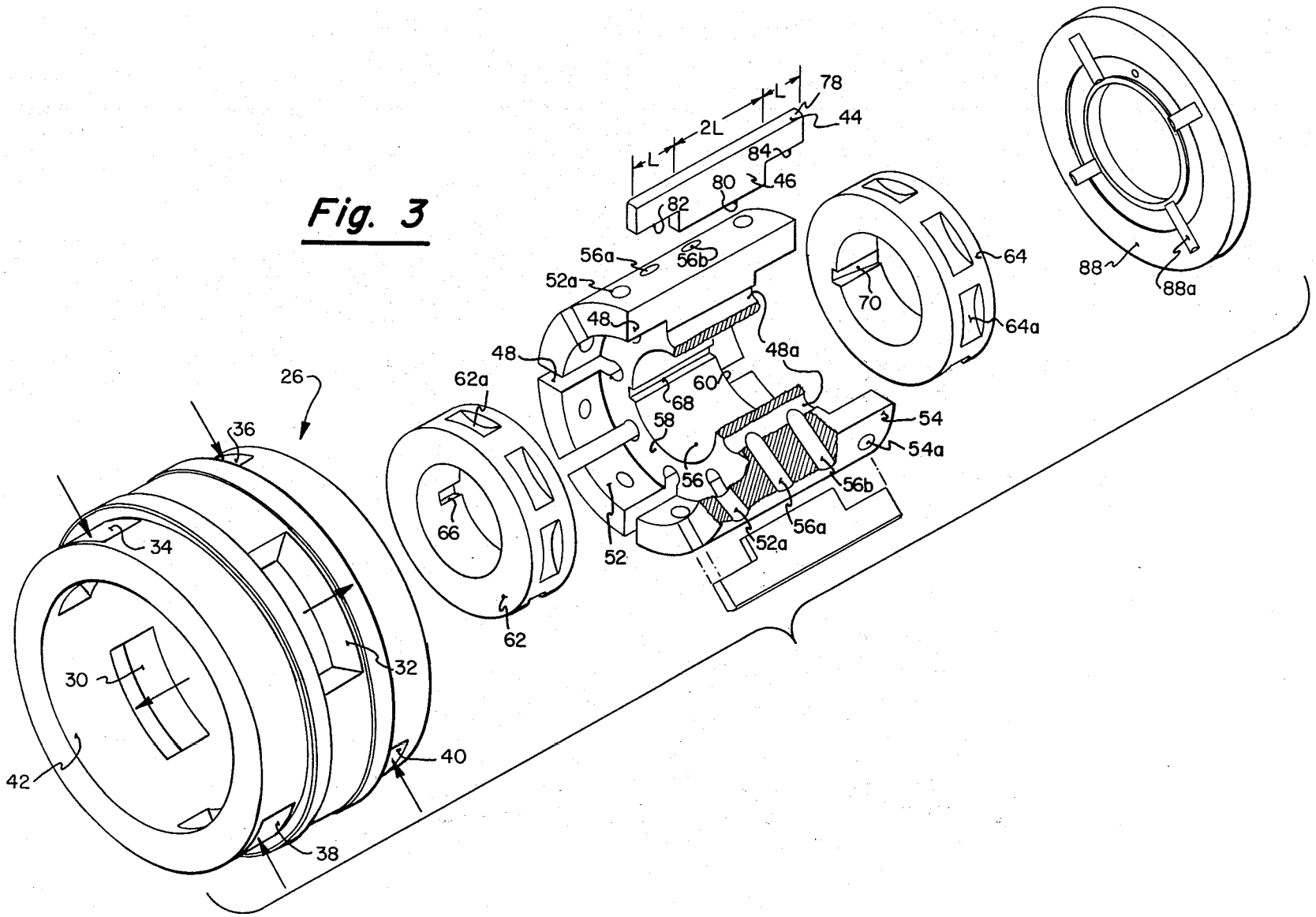
FIG. 3 is an exploded perspective view of certain of the elements which constitute the core of the pump.

Referring to the FIGS. 1, 2, and 3, there is shown a vane pump of the invention. The pump comprises a housing, designated generally by reference numeral 10, which is partially constituted by outer sections 12 and 14 which define a cavity containing an inner section 16. Housing 10 embodies diametrically opposed inlet conduits 18 and 20 (which bifurcate) and diametrically opposed outlet conduits 22 and 24.

Positioned within the housing section 16 is a cam block 26, maintained in proper angular orientation with respect thereto by a locator pin 28. The cam block 26, which forms part of the housing, is provided with two diametrically opposed radial discharge ports 30 and 32 and four radial inlet ports 34, 36, 38, and 40. Ports 34 and 36 are laterally adjacent, as are ports 38 and 40. As best shown in FIG. 3, the ports 34 and 38 and the ports 36 and 40 form diametrically opposed pairs. The interior periphery of the cam block 26 constitutes a highly polished cam surface 42 over which the tips 44 of vanes 46 may travel.

The vanes 46 are mounted for radial inward and outward sliding movement within the outwardly facing radial slots 48 of a rotor, generally indicated at 50. The rotor 50 has an outboard portion, comprised of two segments 52 and 54, through which the slots 48 completely extend and an inboard port 56 of an enlarged radial dimension through which the slots partially extend. It will be seen, in FIG. 3, that the slots 48 terminate in cylindrical longitudinally extending undervane volumes **48*a* which are in communication with the respective central undersides of the vanes. Undervane pumping is directed through respective circumferential arrays of outboard radially extending passages 52*a* and 54*a*. In addition, undervane pumping is directed through respective circumferential arrays of inboard radially extending passages 56*a* and 56*b*. As will be more fully described hereinafter, the passages 52*a*, 54*a*, 56*a*, and 56*b*** also function to hydraulically balance the vanes in the radial direction.

The recesses defined in the outboard ends of the rotor by the inner periphery thereof and the walls 58 and 60 of the inboard portion 56, which are disposed in planes perpendicular to the rotor's axis, receive end caps 62 and 64. The end caps, which are made of hardened steel, are cylindrical members having a plurality of circumferentially distributed recesses **62*a* and 64*a*, the function of which will be made apparent hereinafter. The end caps 62 and 64 are formed so as to make a close fit with the inner periphery of the rotor and lie in abutting relationship with the respective walls 58 and 60 of the rotor inboard portion. The end caps are preferably of such a width that they extend just beyond (e.g., 0.0001 of an inch) the ends of the rotor so as to perform as a bearing surface. As best shown in FIG. 2, each recess 62***a* communicates exclusively with a selected passage 52*a* and an adjacent slot 48. In like manner, each recess 64*a* communicates with a passage 54*a* and an adjacent slot 48. With reference to FIGS. 1, 2, and 3, when the end caps 62 and 64 are inserted in the rotor, aligned slots 66, 68, and 70 form a keyway adapted to receive a key 72 mounted in a confronting slot 74 in a drive shaft 76. Of course, such an arrangement prevents relative rotation between the caps 62 and 64 and the rotor 50.

The rotor assembly (which includes the rotor 50 and end caps 62 and 64) incorporates a plurality of T-shaped vanes 46 mounted for inward and outward radial sliding movement within the slots 48. The radially outer end of each vane has the usual rounded tip 44 with apex 78 (when viewed in cross section) which travels over the cam surface 42 in sealing engagement therewith. Each vane has an undervane surface constituted by an inboard portion 80 and an outboard portion comprising equal length outboard segments 82 and 84. Preferably, the longitudinal length of the inboard portion 80 generally equals the sum of the lengths of the outboard segments 82 and 84. The vanes, which are just slightly shorter in length than the rotor (e.g., 0.0002 of an inch) are confined to their longitudinal location by the end caps 62 and 64 whose inwardly facing walls are adjacent the ends of the inboard portions of the vanes 46. Hence, the axial ends or extremities of the vanes are not susceptible to sliding over a stationary surface which would be presented by a slideplate. As will subsequently be explained, the entire vane undersurface is subjected to discharge pressure in discharge arcs, inlet pressure in inlet arcs, and both inlet and discharge pressure in sealing arcs.

The rotor assembly is contained between stationary sideplates 86 and 88 (FIG. 1) which are provided with lubrication pockets 86*a* and 88*a*. The sideplates, which may be made of leaded bronze or other bearing material, are urged against the rotating end caps. Since the end caps provide an uninterrupted bearing surface, they can readily support a hydrodynamic lubricating film. The sidepate 88 is urged rightwardly against the end cap 64 by a piston 90 subjected to discharge pressure communicated to the cavity 92 (via a passage 93) and a plurality of springs 94. The primary function of the springs 94 is to urge the piston 90 against the rotor at start-up before sufficient discharge pressure has developed. A flange 96 on the piston 90 is adapted to maintain a cam block piston 98 in engagement with the cam block 26. Of course, the left side of the cam block piston 98 is also exposed to discharge pressure in the cavity 92 so as to be pressure loaded against the cam block. The consequence of this pressure loading is an urging of the end cap 64 and the cam block 16 into respective contact with the sideplate 88 and the housing 14, thereby to enhance pump efficiency.

The drive shaft 76 turns within bearings 100 and 102. Bearing 100, which is attached to the housing section 16 by screw 104, has its inner periphery in communication with discharge pressure via the cavity 92. The inner periphery of bearing 102 is supplied with discharge pressure through a series of connected conduits 106, 108, and 110 respectively located in the housing section 16, housing section 14 and the bearing 88. It will be noted that a stanpipe 112 is interposed between the housing sections 16 and 14 to fluidly interconnect conduits 106 and 108. Also, from FIG. 1, it can be seen that the lubrication pockets 88*a* communicate with the conduit 110 for receiving discharge pressure therefrom by means of ducts 88*b*. The pockets 86*a* in the sideplate 86 are also in communication with discharge pressure via similar ducts 86*b*.

From FIG. 1, it can be seen that the end caps 64 and 66 function to define (together with the slots 48) a plurality of centrally located undervane cavities 114 which respectively communicate with the inboard undervane surface portions 80 of the vanes. Fluid enters and is expelled from the cavities 114 through the passages 56*a* and 56*b*. It will be appreciated that the pressure in the cavities 114 is that pressure which exists in an intervane volume which communicates with the passages 56*a* and 56*b*.

The recesses 62*a* in the end cap 62 serve to define (together with the slots 48 and sideplate 86) a plurality of outwardly located undervane cavities 116 which respectively communicate with the outboard undervane surfaces 82 of the vanes. Fluid enters and is expelled from the cavities through the respective passages 52*a* in the rotor. It will be noted that the pressure in a cavity 116 is that pressure which exists in an intervane volume communicating with its associated passage 62*a*. Similar cavities 118 are defined by recesses 64*a*, slots 48 and sideplate 88 which respectively communicate with the outboard undervane surfaces 84 and interact with the respective passages 54*a* in a similar manner such that the outboard undervane segments of a given vane are always exposed to the same pressure.

During pumping, as the rotor assembly 50 rotates, the vanes have their tips in sliding engagement with the cam surface 42 so as to move radially inwardly while traversing discharge arcs and move radially outwardly while traversing inlet arcs. When traversing a seal arc (which is of constant radius and preferably greater in length than the spacing between adjacent vanes) a vane undergoes no radial displacement. Hence, fluid is expelled from an intervane volume over a discharge arc and enters an intervane volume over an inlet arc. The discharge flow will be supplemented by fluid simultaneously expelled from the cavities 114, 116, and 118 (through the respective passages 56*a*, 56*b*, 52*a*, and 54*a*) during travel of an adjacent vane over a discharge arc since the volume of these cavities is progressively decreased during radially inward vane movement. The cavities 114, 116, and 118 have their volumes progressively increased when an adjacent vane travels over an inlet arc and therefore receive fluid via the respective radial passages 56*a*, 56*b*, 52*a*, and 54*a* during such vane travel. When a vane traverses a seal arc, the undervane cavities are neither enlarged nor restricted since the vane maintains a constant radial position.

Figure 4:
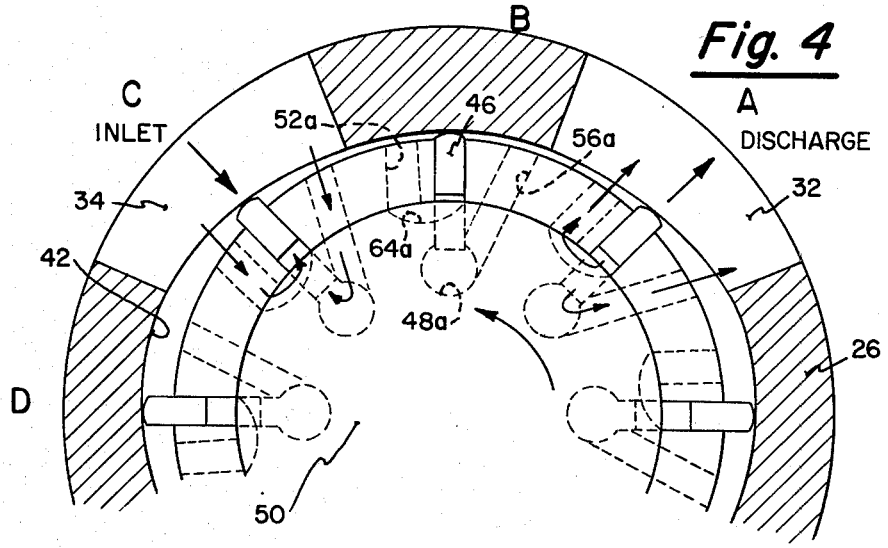
FIG. 4 is a schematic transverse view of the pump showing the vanes at various angular positions.
Figure 5:
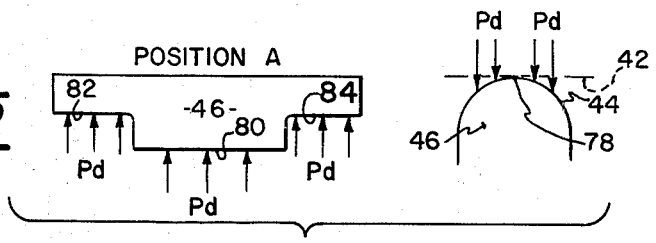
FIGS. 5, 6, 7 and 8 are diagrams illustrating the forces acting on a vane at the respective positions A, B, C, and D of FIG. 4.

Reference to FIGS. 4 and 5 will contribute to a more complete understanding of the forces to which a vane may be subjected to in its travel over the cam surface. Stations A, B, C, and D of FIG. 4 show a vane in respective positions in a discharge arc, a contiguous seal arc, a contiguous inlet arc, and, finally, a contiguous seal arc. It is, again, important to note that, irrespective of a vane's position within a discharge, inlet or seal arc, one undervane portion of the vane will be subjected to the pressure on one side thereof while another undervane portion will be subjected to the pressure on the other side thereof.

A vane in station A (FIG. 5) will have its inboard undervane surface portion 80 subjected to discharge pressure Pd and both segments 82 and 84 of the outboard undervane surface portions also subjected to same pressure. In station A, the pressure is the same on both sides of the vane and therefore the pressure Pd exists in the undervane cavities 114, 116, and 118. Since the entire tip 44 of the vane is exposed to discharge pressure Pd the vane is hydraulically balanced in the radial direction.

Figure 6:
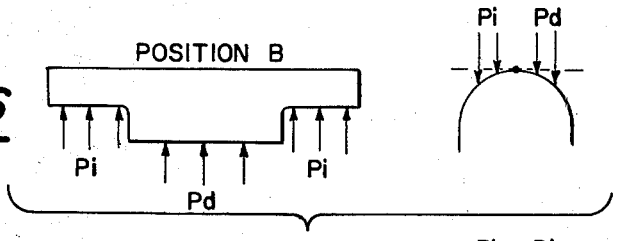

In station B, the apex 78 of the tip 44 will establish a line of contact with the cam surface, whereby the right side of the rounded surface thereof is exposed to discharge pressure and the left side of the rounded surface thereof is exposed to inlet pressure Pi, as is clearly shown in FIG. 6. The pressure on the tip 44 is opposed by the pressure Pd in cavity 114 acting upon the undervane portion 80 and the pressure Pi in the cavities 116 and 118 acting upon undervane segments 82 and 84. Since the segments 82 and 84 are both of length L and the portion 80 is of length 2L (the tip being of length 4L), the radial forces on the vane are in balance, whereby a vane will not have a tendency to depart from the cam surface which encompasses station B.

Figure 7:
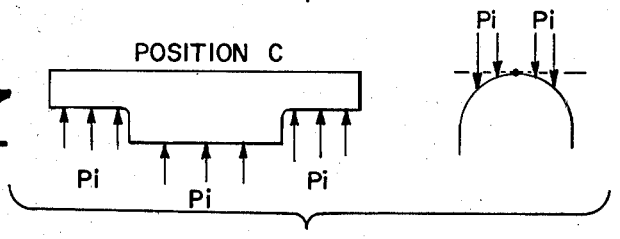

In the adjacent inlet arc which embraces station C, the vane will have inlet pressure on both sides thereof. Therefore, since the cavities 114, 116 and 118 are at inlet pressure Pi and the entire tip 44 of the vane is exposed to inlet pressure, the vane is hydraulically balanced in the radial direction. As depicted in FIG. 7, the entire vane undersurface is subjected to inlet pressure Pi.

Figure 8:
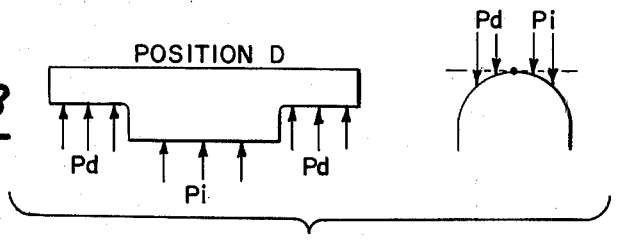

Turning to station D, the vane is in a seal arc with inlet pressure on the upper side and discharge pressure on the lower side. The upper and lower sides of the tip 44 are referenced to inlet pressure and discharge pressure, respectively. Cavity 114 is in communication with inlet pressure while cavities 116 and 118 communicate with discharge pressure, thereby subjecting undervane surface portion 80 to inlet pressure and undervane surface segments 82 and 84 to discharge pressure. Such a pressure distribution pattern is illustrated in FIG. 8. As is the case with station B, the vane in station D is hydraulically balanced.

It will, of course, be appreciated by those skilled in the art that in pumps with seal arcs having an arc length greater than the intervane spacing, the pressure on a side of a vane may not be equal to the discharge pressure or the inlet pressure but may assume values somewhere therebetween. However, this will not affect hydraulic balance since the cavities are exposed to the actual pressures existing adjacent the sides of their associated vane. Hence, it will be understood that the invention is equally applicable to pumps in which the seal arcs overlap an intervane spacing as well as to pumps in which the seal arcs underlap an intervane spacing.

The invention is not limited to pumps embodying pressure balanced rotors wherein there are two diametrically opposed seal arcs and two diametrically opposed discharge arcs. It will be noted that the invention could readily be incorporated in pumps having only one discharge arc and one inlet arc with a seal arc therebetween. In such a case the vanes may, if desired, be hydraulically balanced in the seal arc as heretofore explained with the total outboard undervane surface equal in length to the inboard undervane surface. However, it is most important to note that the total outboard undervane surface length could also be different from the inboard undervane length whereby a resultant radial pressure force will supplement the centrifugal force urging the vane tip into engagement with the cam surface in the seal arc.

Figure 9:
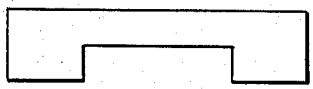
FIGS. 9 and 10 show respective alternative vane shapes.
Figure 10:
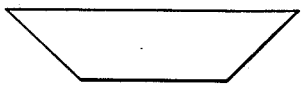

The vane may have shapes other than the T-shaped previously discussed as long as the rotor assembly is designed to subject a portion of the undervane surface to a pressure on one side of the vane and another portion of the undervane surface to a pressure on the other side of the vane. As shown in FIGS. 9 and 10, the vanes may possibly respectively have a channel shape or a trapezoidal shape. Other shapes are also within the contemplation of the invention.

Obviously, many modifications and variations are possible in light of the above teachings without departing from the spirit and scope of the invention as defined in the appended claims.

I claim:

1. In a vane pump of the type comprising: a housing with a cam surface therein defining a pumping cavity, the cam surface including a discharge arc, an inlet arc and a seal arc therebetween; a rotor, having a plurality of outwardly facing radial slots, mounted for rotation within the pumping cavity, and a plurality of vanes respectively mounted in the slots for radial inward and outward movement, each vane having an undervane surface and a radially outer tip adapted to slidingly engage the cam surface during rotation of the rotor, the improvement comprising:

the undervane surface of each vane comprising an inboard surface portion and an outboard surface portion defined by two outboard surface segments;

the rotor having a plurality of first passages which each fluidly interconnect the outer peripheral surface thereof adjacent the advancing side of an associated vane and a portion of its undervane surface in all of the cam surface arcs;

the rotor further having a plurality of second passages which each fluidly interconnect the outer peripheral surface thereof adjacent the trailing side of a vane associated with a first passage and the other portion of its undervane surface in all of the cam surface arcs; and two end caps respectively mounted in the outboard portions of the rotor such that they project slightly beyond the axial ends thereof.

2. The improvement of claim 1, wherein each end cap comprises:

a plurality of circumferentially distributed peripheral recesses respectively communicating with an outboard portion of a vane slot, and wherein the first passages are formed in respective circumferential arrays in the ouboard portions of the rotor such that each first pssage in one of the outboard portions communicates with a different recess in its adjacent end cap and each first passage in the other outboard portion communicates with a different recess in its adjacent end cap.

3. The improvement of claim 1, wherein the sum of the lengths of the two outboard surface segments is equal to the length of the inboard surface portion.

4. The improvement of claim 3, wherein the vane pump is of the type in which the cam surface includes another discharge arc, another inlet arc and another seal arc which are respectively diametrically opposed to the first mentioned discharge arc, inlet arc and seal arc and wherein the vanes are T-shaped.

5. In a vane pump adapted for undervane pumping of the type comprising: a housing with a cam surface therein defining a pumping cavity, the cam surface being constituted by two diametrically opposed discharge arcs, two diametrically opposed inlet arc and two diametrically opposed seal arcs respectively located between a discharge arc and an inlet arc; a generally cylindrical rotor assembly, having a plurality of outwardly facing radial slots, mounted for rotation within the pumping cavity and incorporating a plurality of vanes respectively mounted in the slots for radial inward and outward movement, each vane having an undervane surface and a radially outer rounded tip adapted to slidingly engage the cam surface during rotation of the rotor assembly; and two sideplates mounted in the housing in respective engagement with the ends of the rotor assembly, the improvement in the rotor assembly comprising:

a rotor having an outboard portion comprised of two segments and an inboard portion of an enlarged radial dimension, the outboard portion and the inboard portion defining two recesses in the ouboard ends of the rotor and the radial slots extending completely through the segments of the outboard portion and extending partially through the inboard portion;

two end caps respectively received in the recesses of the rotor so as to make a close fit with the inner periphery of the rotor and lie in abutting relationship with the inboard portion of the rotor, the end caps being of such a width to extend just beyond the ends of the rotor so as to provide bearing surfaces which respectively engage the sideplates, each of the end caps having a plurality of peripheral recesses circumferentially distributed such that each recess communicates exclusively with an outboard portion of a vane slot;

each vane being T-shaped such that the undervane surface is constituted by an inboard surface portion and an outboard surface portion defined by two outboard surface segments, the sum of the lengths of the outboard surface segments of each vane being equal to the length of the inboard surface portion thereof and the outboard surface segments of each vane being generally coextensive with the respective segments of the outboard portion of the rotor;

first passage means to establish fluid communication between the inboard surface portion of each vane and the outer peripheral surface of the rotor adjacent one of its sides in all of the cam surface arcs; and second passage means to establish fluid communication between the outboard surface segments of each vane and the outer peripheral surface of the rotor adjacent the other of its sides in all of the cam surface arcs.

6. The improvement of claim 5, wherein the second passage means comprises:

two circumferential arrays of radial passages respectively located in the segments of the outboard portion of the rotor, each of the radial passages communicating with the outer peripheral surface of the rotor and each of the radial passages communicating exclusively with a peripheral recess in the adjacent end cap.

* * * * *